US009228743B2

(12) United States Patent
Cadima et al.

(10) Patent No.: US 9,228,743 B2
(45) Date of Patent: Jan. 5, 2016

(54) GAS BURNER ASSEMBLY

(71) Applicant: General Electric Company, Schenectady, NY (US)

(72) Inventors: Paul Bryan Cadima, Prospect, KY (US); Bai Han, Chadds Ford, PA (US); Gonzalo Luis Ocano, Louisville, KY (US)

(73) Assignee: General Electric Company, Schenectady, NY (US)

( * ) Notice: Subject to any disclaimer, the term of this patent is extended or adjusted under 35 U.S.C. 154(b) by 336 days.

(21) Appl. No.: 13/739,261

(22) Filed: Jan. 11, 2013

(65) Prior Publication Data

US 2014/0199647 A1 Jul. 17, 2014

(51) Int. Cl.

| | |
|---|---|
| ***F23C 7/00*** | (2006.01) |
| ***F23D 14/10*** | (2006.01) |
| ***F23D 14/46*** | (2006.01) |
| ***F23D 14/64*** | (2006.01) |

(52) U.S. Cl.

CPC ..... *F23D 14/10* (2013.01); *F23D 14/46* (2013.01); *F23D 14/64* (2013.01); *F23D 2203/007* (2013.01); *F23D 2213/00* (2013.01)

(58) Field of Classification Search

CPC ..... F23D 14/06; F23D 14/08; F23D 14/10; F23D 14/64

USPC ..... 126/19.1, 41 R; 431/158, 352, 353, 354

See application file for complete search history.

(56) References Cited

U.S. PATENT DOCUMENTS

| | | | | |
|---|---|---|---|---|
| 2,815,070 | A * | 12/1957 | Lamar | 48/180.1 |
| 3,399,024 | A * | 8/1968 | Branson | 431/286 |
| 5,025,990 | A | 6/1991 | Ridenour | |
| 5,193,273 | A * | 3/1993 | Riehl | 29/890.01 |

FOREIGN PATENT DOCUMENTS

| | | |
|---|---|---|
| GB | 1321847 | 7/1973 |

* cited by examiner

*Primary Examiner* — Avinash Savani
*Assistant Examiner* — Vivek Shirsat
(74) *Attorney, Agent, or Firm* — Dority & Manning, P.A.

(57) ABSTRACT

The present subject matter provides a gas burner assembly for an appliance. The gas burner assembly includes a burner tube and a shutter slidably mounted to an end portion of the burner tube. The shutter defines a slot with an axially extending portion. A boss is mounted to the tubular burner and is received within the slot of the shutter. The boss is movable within the axially extending portion of the slot in order to permit the shutter to slide along an axial direction on the burner tube. Such features can facilitate access to an orifice of the gas burner assembly.

14 Claims, 4 Drawing Sheets

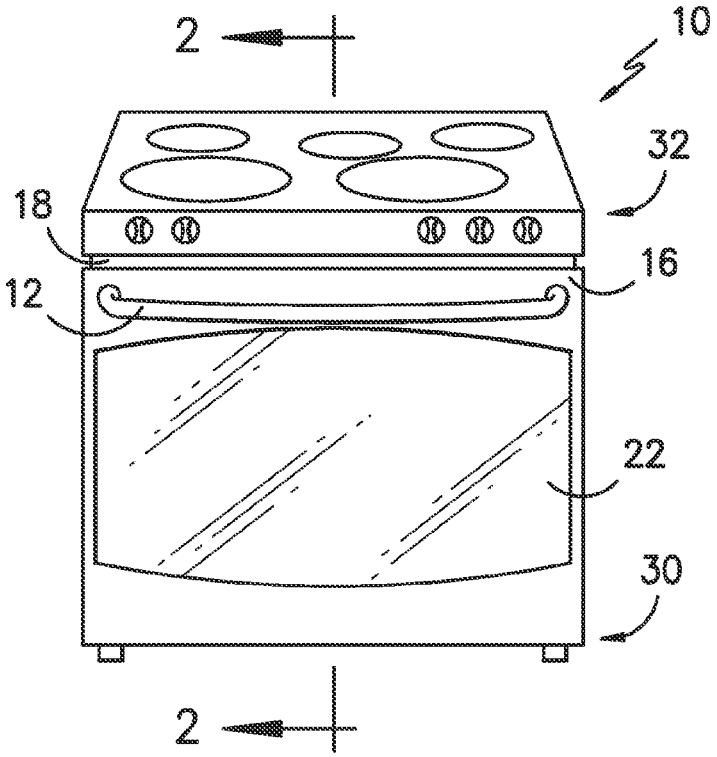
FIG. —1—
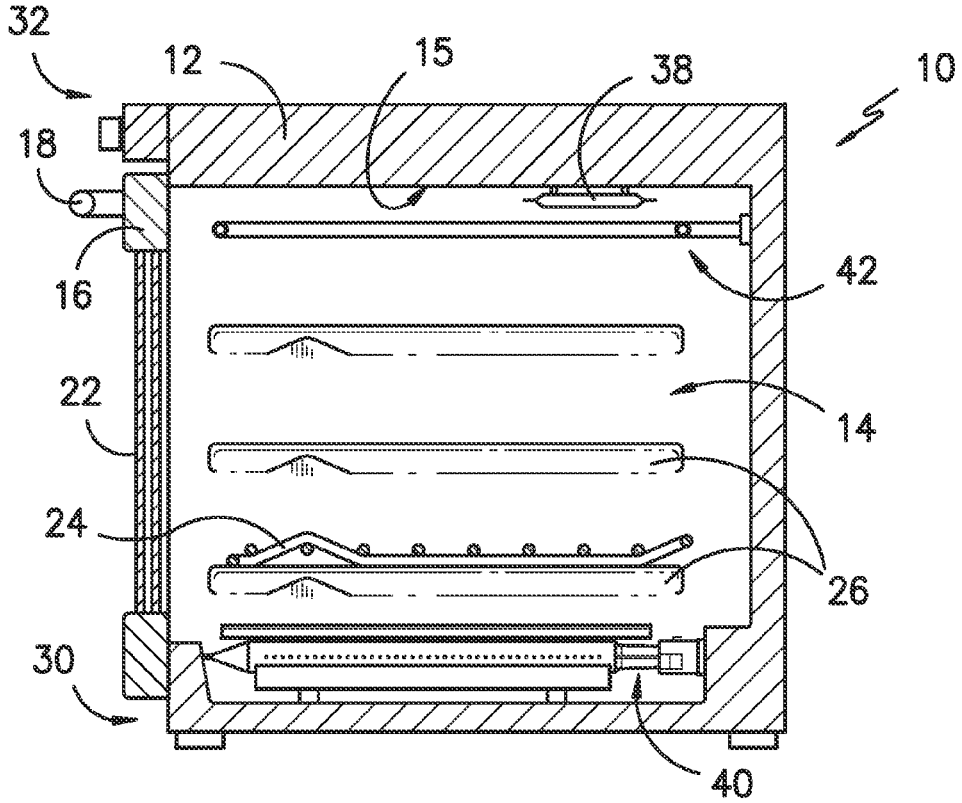
FIG. —2—

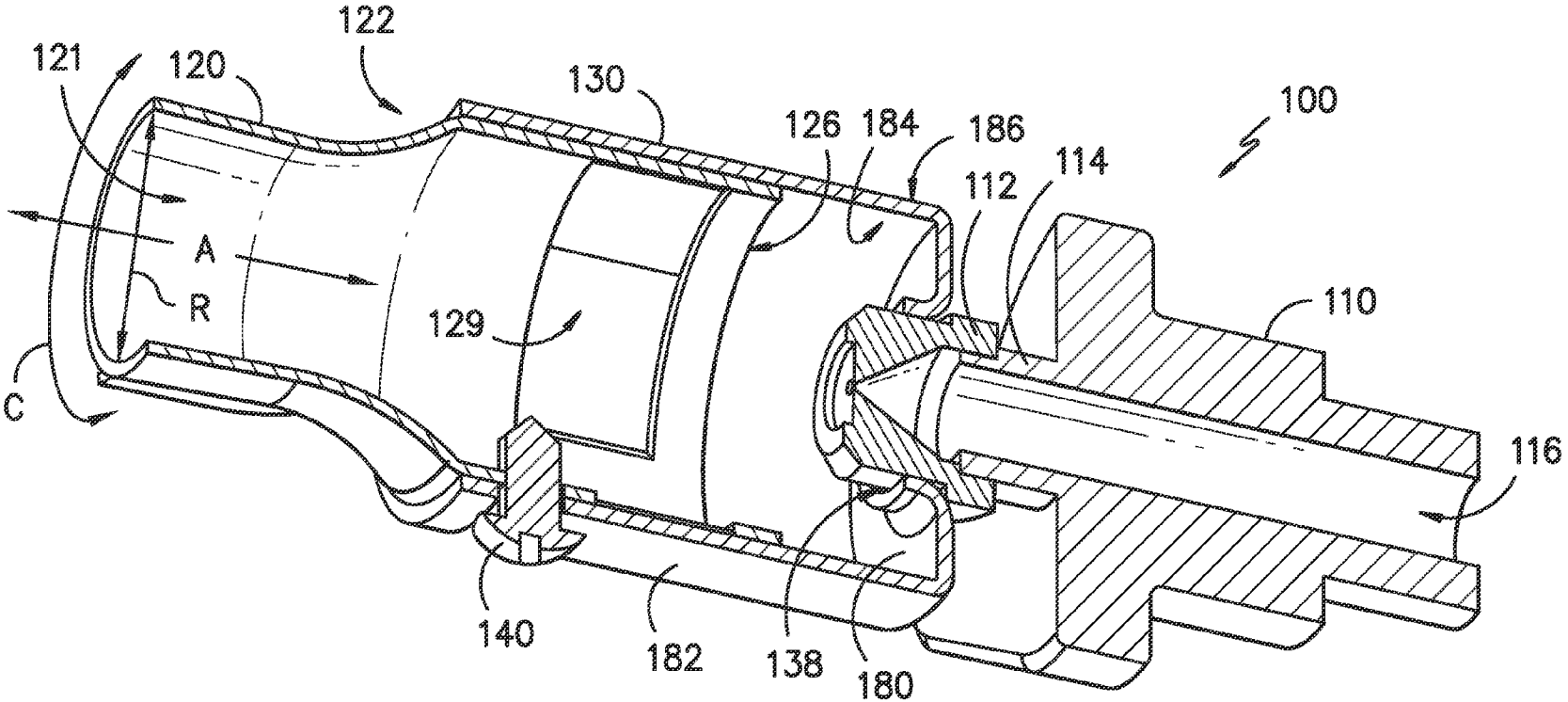
FIG. —4—

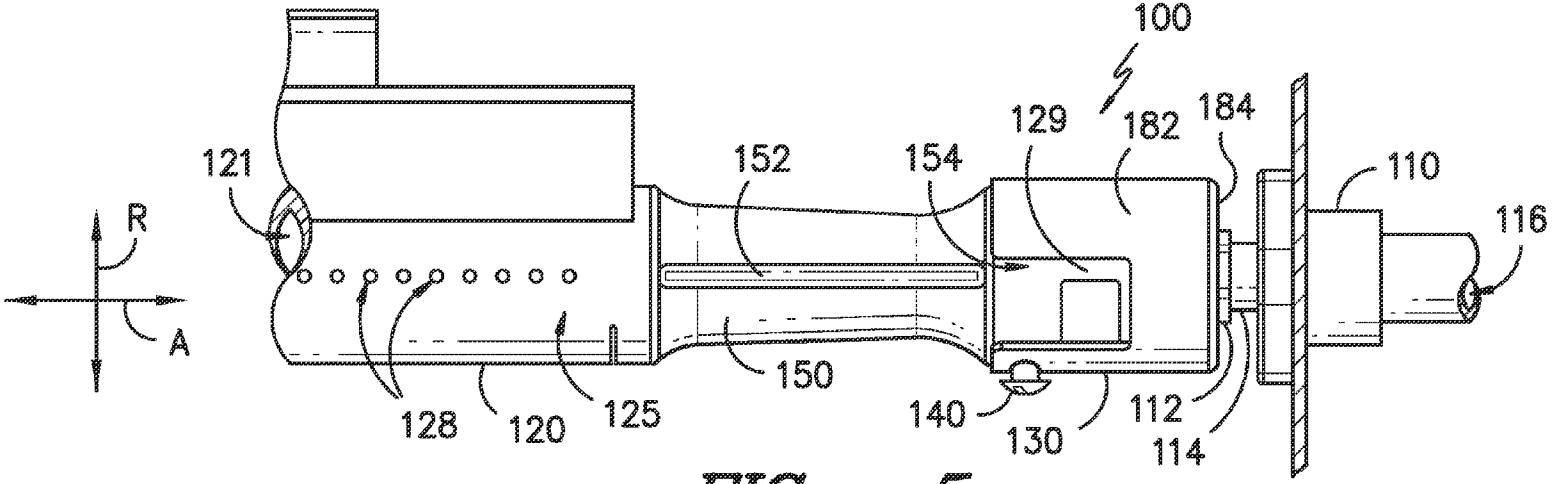
FIG. —5—
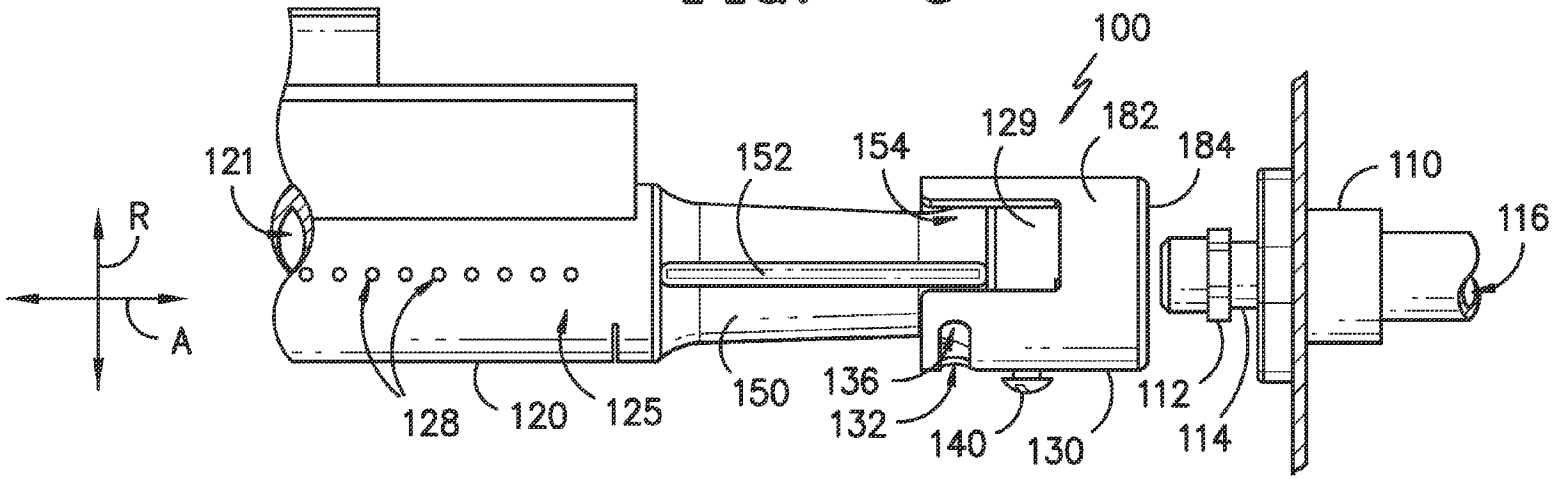
FIG. —6—

GAS BURNER ASSEMBLY

FIELD OF THE INVENTION

The present subject matter relates generally to gas burner assemblies, such as gas burner assemblies for appliances.

BACKGROUND OF THE INVENTION

Certain appliances combust gaseous fuel with their associated gas burner assemblies, e.g., to heat water, food items, or air. Gas burner assemblies within such appliances can combust various gaseous fuels. In particular, certain gas burner assemblies are configured for combusting either propane or natural gas, two common gaseous fuels. Such gas burner assemblies also generally include features permitting a user to convert the gas burner to properly burn either fuel. In certain gas burner assemblies, an orifice within the gas burner assembly can be replaced or changed to switch between fuels. Thus, appliances configured for burning natural gas can be converted to burn propane by replacing a natural gas orifice with a propane orifice within the appliances' gas burner assembly.

Appliances with gas burner assemblies are generally shipped with multiple orifices each corresponding to a particular fuel type. During installation of the appliance, the appliance can be converted to properly burn either propane or natural gas. In particular, the appliance's regulator can be adjusted to a different operating pressure, the proper orifice can be selected and installed in the appliance's gas burner assembly, and the appliance's shutter can be adjusted, if required. However, accessing and replacing the gas burner assembly's orifice can be difficult and tedious. In particular, various components of the gas burner assembly may need to be removed to access and replace the gas burner assembly's orifice.

Accordingly, a gas burner assembly with features for facilitating access to an orifice of the gas burner assembly would be useful. In particular, a gas burner assembly with features for facilitating replacement or changing of an orifice of the gas burner assembly without removing the gas burner assembly would be useful.

BRIEF DESCRIPTION OF THE INVENTION

The present subject matter provides a gas burner assembly for an appliance. The gas burner assembly includes a burner tube and a shutter slidably mounted to an end portion of the burner tube. The shutter defines a slot with an axially extending portion. A boss is mounted to the tubular burner and is received within the slot of the shutter. The boss is movable within the axially extending portion of the slot in order to permit the shutter to slide along an axial direction on the burner tube. Such features can facilitate access to an orifice of the gas burner assembly. Aspects and advantages of the invention will be set forth in part in the following description, or may be apparent from the description, or may be learned through practice of the invention.

In a first exemplary embodiment, a gas burner assembly for an appliance is provided. The gas burner assembly defines a radial direction, a circumferential direction, and an axial direction. The gas burner assembly includes a gas line bracket having an orifice and a burner tube. The burner tube extends between a first end portion and a second end portion along the axial direction. The burner tube defines an inlet at the first end portion of the burner tube and a plurality of outlets distributed between the first end portion of the burner tube and the second end portion of the burner tube along the axial direction. The burner tube also defines a window at the first end portion of the burner tube. A shutter is slidably mounted to the burner tube at the window of the burner tube. The shutter defines an opening for receipt of the orifice of the gas line bracket. The shutter also defines a slot having an axially extending portion and a circumferentially extending portion. A boss is mounted to the burner tube and received within the slot of the shutter so as to guide movement of the shutter along the axial and circumferential directions.

In a second exemplary embodiment, a gas burner assembly for an appliance is provided. The gas burner assembly defines a radial direction, a circumferential direction, and an axial direction. The gas burner assembly includes a gas line bracket having an orifice and a burner tube. The burner tube extends between a first end portion and a second end portion along the axial direction. The burner tube defines an inlet at the first end portion of the burner tube. A cover is slidably mounted to the burner tube at the first end portion of the burner tube. The cover defines an opening for receipt the orifice of the gas line bracket. The cover also defines a slot having an axially extending portion. A boss is mounted to the burner tube and received within the slot of the cover so as to guide movement of the shutter along the axial direction.

In a third exemplary embodiment, a gas burner assembly for an appliance is provided. The gas burner assembly defines a radial direction, a circumferential direction, and an axial direction. The gas burner assembly includes a burner tube that extends between a first end portion and a second end portion along the axial direction. The burner tube defines an inlet at the first end portion of the burner tube and a plurality of outlets distributed between the first end portion of the burner tube and the second end portion of the burner tube along the axial direction. The burner tube also defines a window at the first end portion of the burner tube. A shutter is slidably mounted to the burner tube at the window of the burner tube. The shutter also defines a slot having an axially extending portion and a circumferentially extending portion. A boss is mounted to the burner tube and received within the slot of the shutter so as to guide movement of the shutter along the axial and circumferential directions.

These and other features, aspects and advantages of the present invention will become better understood with reference to the following description and appended claims. The accompanying drawings, which are incorporated in and constitute a part of this specification, illustrate embodiments of the invention and, together with the description, serve to explain the principles of the invention.

BRIEF DESCRIPTION OF THE DRAWINGS

A full and enabling disclosure of the present invention, including the best mode thereof, directed to one of ordinary skill in the art, is set forth in the specification, which makes reference to the appended figures.

FIG. 1 provides a perspective view of a range appliance according to an exemplary embodiment of the present subject matter.

FIG. 2 provides a section view of the range appliance of FIG. 1 taken along the 2-2 line of FIG. 1.

FIG. 4 provides a partial, section view of the gas burner assembly of FIG. 3.

FIG. 5 provides a partial, elevation view of the gas burner assembly of FIG. 3 with a shutter of the gas burner assembly shown mounted over an orifice of a gas line bracket of the gas burner assembly.

FIG. 6 provides a partial, elevation view of the gas burner assembly of FIG. 3 with a shutter of the gas burner assembly shown retracted from the orifice of the gas line bracket.

DETAILED DESCRIPTION OF THE INVENTION

Figure 3:
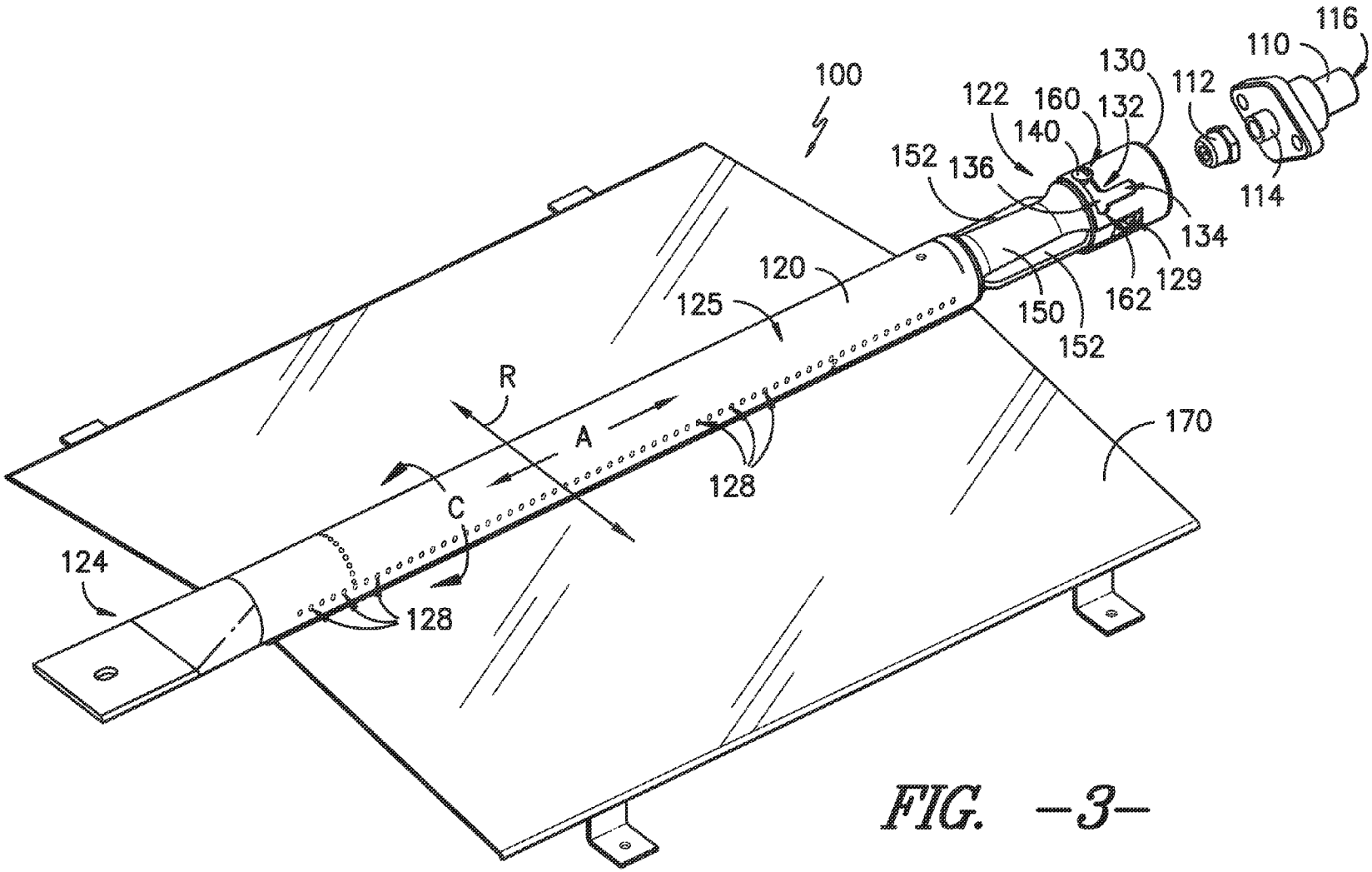
FIG. 3 provides an exploded view of a gas burner assembly according to an exemplary embodiment of the present subject matter.

Reference now will be made in detail to embodiments of the invention, one or more examples of which are illustrated in the drawings. Each example is provided by way of explanation of the invention, not limitation of the invention. In fact, it will be apparent to those skilled in the art that various modifications and variations can be made in the present invention without departing from the scope or spirit of the invention. For instance, features illustrated or described as part of one embodiment can be used with another embodiment to yield a still further embodiment. Thus, it is intended that the present invention covers such modifications and variations as come within the scope of the appended claims and their equivalents.

FIG. 1 provides a perspective view of a range appliance 10 according to an exemplary embodiment of the present subject matter. FIG. 2 provides a section view of range appliance 10 taken along the 2-2 line of FIG. 1. Range appliance 10 is provided by way of example only and is not intended to limit the present subject matter in any aspect. Thus, the present subject matter may be used with other range appliance configurations, e.g., that define multiple interior cavities for the receipt of food and/or having different pan or rack arrangements than what is shown in FIG. 2. Further, the present subject matter may be used in any other suitable appliance, e.g., an oven appliance, a water heater appliance, or a dryer appliance.

Range appliance 10 includes an insulated cabinet 12 with an interior cooking chamber 14 defined by an interior surface 15 of cabinet 12. Cooking chamber 14 is configured for the receipt of one or more food items to be cooked. Range appliance 10 includes a door 16 rotatably mounted to cabinet 12, e.g., with a hinge (not shown). A handle 18 is mounted to door 16 and assists a user with opening and closing door 16 in order to access cooking chamber 14. For example, a user can pull on handle 18 to open or close door 16 and access cooking chamber 14.

Range appliance 10 can includes a seal (not shown) between door 16 and cabinet 12 that assist with maintaining heat and cooking fumes within cooking chamber 14 when door 16 is closed as shown in FIG. 2. Multiple parallel glass panes 22 provide for viewing the contents of cooking chamber 14 when door 16 is closed and assist with insulating cooking chamber 14. A baking rack 24 is positioned in cooking chamber 14 for the receipt of food items or utensils containing food items. Baking rack 24 is slidably received onto embossed ribs or sliding rails 26 such that rack 24 may be conveniently moved into and out of cooking chamber 14 when door 16 is open.

A gas fueled, bottom heating element 40 (e.g., a gas burner or a bake gas burner) is positioned in cabinet 12, e.g., at a bottom portion 30 of cabinet 12. Bottom heating element 40 is used to heat cooking chamber 14 for both cooking and cleaning of range appliance 10. The size and heat output of bottom heating element 40 can be selected based on the e.g., the size of range appliance 10.

A top heating element 42 is also positioned in cooking chamber 14 of cabinet 12, e.g., at a top portion 32 of cabinet 12. Top heating element 42 is used to heat cooking chamber 14 for both cooking/broiling and cleaning of range appliance 10. Like bottom heating element 40, the size and heat output of top heating element 42 can be selected based on the e.g., the size of range appliance 10. In the exemplary embodiment shown in FIG. 2, top heating element 42 is shown as an electric resistance heating element. However, in alternative embodiments, a gas, microwave, halogen, or any other suitable heating element may be used instead of electric resistance heating element 42.

The operation of range appliance 10 including heating elements 40 and 42 is controlled by one or more processing devices (not shown) such as a microprocessor or other device that is in communication with such components. Such processing device (used herein to refer generally to single and/or multiple processing devices) is also in communication with a temperature sensor 38 that is used to measure temperature inside cooking chamber 14 and provide such measurements to the process device. Temperature sensor 38 is shown (in FIG. 2) in the top and rear of cooking chamber 14. However, other locations may be used and, if desired, multiple temperature sensors may be applied as well.

Range appliance 10 can be installed in various residences or businesses that have different fuel sources, such as natural gas or propane. Utilizing bottom heating element 40 to burn propane can require a different configuration than utilizing bottom heating element 40 to burn natural gas. Thus, range appliance, e.g., bottom heating element 40, can require modification or reconfiguration depending upon the available fuel and the current configuration of range appliance 10. For example, if range appliance 10 is configured for burning natural gas, range appliance 10 can require reconfiguration before being capable of burning propane. Range appliance 10, e.g., bottom heating element 40, includes features for assisting with changing between various operating fuels. Such features are discussed in greater detail below.

FIG. 3 provides an exploded view of a gas burner assembly 100 according to an exemplary embodiment of the present subject matter. FIG. 4 provides a partial section view of gas burner assembly 100. Gas burner assembly 100 may be used in any suitable appliance, e.g., an oven appliance, a range appliance, a water heater appliance, or a dryer appliance. As an example, gas burner assembly 100 may be utilized in range appliance 10 as bottom and/or top heating elements 40 and 42 (FIG. 2).

Gas burner assembly 100 defines a radial direction R, a circumferential direction C, and an axial direction A. As may be seen in FIG. 3, gas burner assembly 100 includes a flame spreader 170. As will be understood by those skilled in the art, flame spreader 170 can assist with distributing and guiding thermal energy generated by combustion of fuel by gas burner assembly 100.

Gas burner assembly 100 also includes a gas line bracket 110. Gas line bracket 110 includes a supply line 116 configured for receipt of a gaseous fuel from a fuel source (not shown), such as a utility fuel line or a fuel tank. The gaseous fuel supplied by the fuel source can be any suitable gaseous fuel. For example, supply line 116 can receive propane, natural gas, or producer gas.

Gas line bracket 110 also has an orifice 112. Orifice 112 is mounted on a post 114 of gas line bracket 110. As an example, orifice 112 can be screwed onto threads of post 114. Gas line bracket 110 can accept multiple orifices, e.g., a natural gas orifice configured or sized for natural gas and a propane orifice configured or sized for propane. Such orifices can be switched or substituted for each other in order to adjust gas burner assembly 100 between combustion of natural gas and propane as discussed in greater detail below.

Gas burner assembly 100 also includes a burner tube 120, e.g., mounted to flame spreader 170. Burner tube 120 extends between a first end portion 122 and a second end portion 124, e.g., along the axial direction A. Burner tube 120 can be crimped or in some other manner sealed shut at second end portion 124 of burner tube 120. Burner tube 120 defines an inlet 126 at first end portion 122 of burner tube 120. Inlet 126 is configured for receipt of fuel from orifice 112 of gas line bracket 110. For example, fuel from supply line 116 can pass through orifice 112 into a passage 121 defined by burner tube 120 via inlet 126.

Burner tube 120 also defines a plurality or series of outlets 128. Outlets 128 are distributed along the axial direction A, e.g., between first end portion 122 of burner tube 120 and second end portion 124 of burner tube 120. Outlets 128 direct fuel/air mixture out of passage 121 of burner tube 120. At or outside of outlets 128, such fuel can be burned or combusted, e.g., to heat water, food items, or air.

Burner tube 120 also defines a window 129, e.g., at first end portion 122 of burner tube 120. Window 129 is configured for permitting a flow of air into passage 121 of burner tube 120. Within passage, such air can mix with fuel from orifice 112, e.g., to assist with combustion of such fuel at outlets 128 of burner tube 120. Burner tube 120 includes a Venturi throat 150, e.g., positioned at first end portion 122 of burner tube 120, to assist with mixing of fuel and air within passage 121 of burner tube 120.

Venturi throat 150 has a smaller cross-sectional area, e.g., in a plane that is perpendicular to the axial direction A, than other portions of burner tube 120. Thus, fluids flowing therethrough can increase in velocity and drop in pressure, thereby assisting within mixing of the same. Venturi throat 150 can be formed by stamping burner tube 120 to achieve the reduced cross-section discussed above. As a result of such stamping, Venturi throat 150 can include wings 152 of excess material. Wing 152 can extend along the axial direction A.

Burner tube 120 and orifice 112 of gas line bracket 110 are coaxially aligned, e.g., in the axial direction A. Thus, burner tube 120 and orifice 112 of gas line bracket 110 can be concentrically positioned to each other, e.g., in the plane that is perpendicular to the axial direction A. However, burner tube 120 and gas line bracket 110 are spaced apart from each other, e.g., along the axial direction A. In particular, first end portion 122 of burner tube 120 and orifice 112 of gas line bracket 110 are spaced apart from each other, e.g., along the axial direction A.

A cover or shutter 130 is slidably mounted to burner tube 120, e.g., at window 129 or first end portion 122 of burner tube 120. Shutter 130 is configured for placing orifice 112 of gas line bracket 110 and passage 121 of burner tube 116 in fluid communication. Thus, shutter 130 can selectively extend between and connect burner tube 120 and gas line bracket 110, e.g., along the axial direction A. In particular, shutter 130 defines an opening 138 configured for receipt of orifice 112 of gas line bracket 110, as discussed in greater detail below.

Shutter 130 has a radial sidewall 180 that extends along the radial direction R and, e.g., defines opening 138. Shutter 130 also includes a circumferential sidewall 182 that extends along the circumferential direction C, e.g., about first end portion 122 of burner tube 120. Circumferential sidewall 182 has an inner surface 184 and an outer surface 186 positioned opposite inner surface 184 such that inner and outer surface 184 and 186 are spaced apart from each other along the radial direction R. Inner surface 184 can contact or rest on burner tube 120. Shutter 130, e.g., circumferential sidewall 182, also defines an aperture 154 (FIG. 5) for selective receipt of wing 152 when shutter 130 slides along the axial direction A on burner tube 120.

Shutter 130 also defines a slot 132. Slot 132 can include an axially extending portion 134 and a circumferentially extending portion 134. Slot 132 can extend along the radial direction R, e.g., between inner and outer surface 184 and 186 of circumferential sidewall 182. A boss 140 is mounted to burner tube 120, e.g., at first end portion 122 of burner tube 120. Boss 140 is received within slot 132 of shutter 130. In particular, boss 140 is slidably received within slot 132 of shutter 130 such that shutter 130 can slide on burner tube 120 and movement of shutter 130 can be guided by boss 140 within slot 132 of shutter 130. In certain exemplary embodiments, boss 140 can be a fastener, such as a screw or bolt. In such exemplary embodiments, boss 140 can be tightened against shutter 130, e.g., in order to fix shutter 130 relative to burner tube 120 and hinder sliding of shutter 130 on burner tube 120.

As discussed, boss 140 is moveable or can slide within slot 132 of shutter 130. In particular, boss 140 is movable within axially extending portion 134 of slot 132, e.g., in order to permit shutter 130 to slide along the axial direction A on burner tube 120. Similarly, boss 140 is movable within circumferentially extending portion 136 of slot 132, e.g., in order to permit shutter 130 to slide along the circumferentially direction C on burner tube 120.

In particular, circumferentially extending portion 136 of slot 132 extends between a first side portion 160 and a second side portion 162 along the circumferential direction C. Thus, first and second side portions 160 and 162 of circumferentially extending portion 136 are spaced apart from each other along the circumferential direction C. Boss 140 is movable within circumferentially extending portion 136 of slot 132 between first side portion 160 of circumferentially extending portion 136 and second side portion 162 of circumferentially extending portion 136. Shutter 130 adjusts an outlet size of window 129 of burner tube 120 when boss 140 moves within circumferentially extending portion 136 of slot 132, e.g., between first side portion 160 of circumferentially extending portion 136 and second side portion 162 of circumferentially extending portion 136. Thus, as an example, a user can rotate shutter 130 on burner tube 120 in order to increase or decrease an outlet size of window 129. In such a manner, the user can increase or decrease a flow of air into passage 121 of burner tube 120 and mixing of air and fuel therein. In particular, window 129 can be sized for operating gas burner assembly 100 on propane when boss 140 is positioned at first side portion 160 of circumferentially extending portion 136, and window 129 can be sized for operating gas burner assembly 100 on natural gas when boss 140 is positioned at second side portion 162 of circumferentially extending portion 136 or vice versa.

Gas burner assembly 100 can be installed in various locations that have different fuel sources, such as natural gas or propane. As discussed above, utilizing gas burner assembly 100 to burn propane can require a different orifice than the orifice required to burn natural gas. Thus, orifice 112 of gas line bracket 110 may require changing depending upon the available fuel and the current configuration of gas burner assembly 100. Gas burner assembly 100 includes features for assisting with changing orifice 112 of gas line bracket 110. Such features are discussed in greater detail below.

FIG. 5 provides a partial, elevation view of gas burner assembly 100 with shutter 130 of gas burner assembly 100 shown mounted over orifice 112 of gas line bracket 110. Conversely, FIG. 6 provides a partial, elevation view of gas burner assembly 100 with shutter 130 of gas burner assembly 100 shown retracted from orifice 112 of gas line bracket 110. By sliding shutter 130, e.g., along the axial direction A, away from orifice 112 of gas line bracket 110, shutter 130 can facilitate access to orifice 112 and permit a user to change orifice 112, e.g., without having to dismount or move burner tube 120.

As an example, from the configuration shown in FIG. 5, a user can access orifice 112 in order to replace or change orifice 112 by sliding shutter 130 on burner tube 120 away from gas line bracket 110. Shutter 130 can slide away from gas line bracket 110 by positioning boss 140 within axially extending portion 134 (FIG. 3) and sliding boss 140 therein, e.g., away from circumferentially extending portion 136 (FIG. 3) of slot 132. In such a manner, shutter 130 can be adjusted from the configuration shown in FIG. 5 to the configuration shown in FIG. 6.

With orifice 112 removed from opening 138 of shutter 130 as shown in FIG. 6, a user can access orifice 112 and, e.g., remove orifice 112 from post 114 and mount a suitable replacement thereon. After orifice 112 is adjusted or replaced, the user can slide shutter 130 towards gas line bracket 110 such that boss 140 slides within axially extending portion 134 of slot 132, e.g., towards circumferentially extending portion 136 of slot 132. In such a manner, orifice 112 can be positioned within opening 138 of shutter 130, e.g., to place passage 121 of burner tube 120 and orifice 112 of gas line bracket 110 in fluid communication and permit operation of gas burner assembly 100.

As may be seen in FIGS. 5 and 6, when shutter 130 slides on burner tube 120 along the axial direction A, wing 152 of Venturi throat 150 is selectively received within aperture 154 of shutter 130. As will be understood by those skilled in the art, wing 152 can extend past an outer surface 125 of burner tube 120 along the radial direction R. Thus, without aperture 154, shutter 130 could impact wing 152 and hinder movement of shutter 130 on burner tube 130 along the axial direction A.

This written description uses examples to disclose the invention, including the best mode, and also to enable any person skilled in the art to practice the invention, including making and using any devices or systems and performing any incorporated methods. The patentable scope of the invention is defined by the claims, and may include other examples that occur to those skilled in the art. Such other examples are intended to be within the scope of the claims if they include structural elements that do not differ from the literal language of the claims, or if they include equivalent structural elements with insubstantial differences from the literal languages of the claims.

What is claimed is:

1. A gas burner assembly for an appliance, the gas burner assembly defining a radial direction, a circumferential direction, and an axial direction, the gas burner assembly, comprising:

a gas line bracket having an orifice;

a burner tube extending between a first end portion and a second end portion along the axial direction, said burner tube spaced apart from the orifice of said gas line bracket at the first end portion of said burner tube, said burner tube defining an inlet at the first end portion of said burner tube and a plurality of outlets distributed between the first end portion of said burner tube and the second end portion of said burner tube along the axial direction, said burner tube also defining a window at the first end portion of said burner tube;

a shutter slidably mounted to said burner tube at the window of said burner tube, said shutter defining an opening for receipt of the orifice of said gas line bracket, said shutter also defining a slot having an axially extending portion and a circumferentially extending portion; and a boss mounted to said burner tube and received within the slot of said shutter so as to guide movement of said shutter along the axial and circumferential directions, wherein said shutter is movable on said burner tube along the axial direction via the axially extending portion of the slot of said shutter between a working position and an orifice changing position, the orifice of said gas line bracket received within the opening of said shutter such that said shutter extends between said burner tube and the orifice of said gas line bracket in the working position, said shutter and said burner tube spaced apart from and not contacting the orifice of said gas line bracket such that the orifice of said gas line bracket is accessible and removable in the orifice changing position, wherein the circumferentially extending portion of the slot extends between a first side portion and a second side portion along the circumferential direction, said boss movable within the circumferentially extending portion of the slot between the first side portion of the circumferentially extending portion and the second side portion of the circumferentially extending portion, said shutter adjusting an outlet size of the window of said burner tube when said boss moves within the circumferentially extending portion of the slot between the first side portion of the circumferentially extending portion and the second side portion of the circumferentially extending portion.

2. The gas burner assembly of claim 1, wherein the first end portion of said burner tube and the orifice of said gas line bracket are spaced apart from each other along the axial direction.

3. The gas burner assembly of claim 1, wherein said burner tube and the orifice of said gas line bracket are coaxially aligned in the axial direction.

4. The gas burner assembly of claim 1, wherein said gas line bracket comprises a threaded post, the orifice of said gas line bracket screwed onto the threaded post of said gas line bracket.

5. The gas burner assembly of claim 1, wherein said burner tube comprises a Venturi throat positioned at the first end portion of said burner tube.

6. The gas burner assembly of claim 5, wherein the Venturi throat of said burner tube comprises a wing that extends along the axial direction, said shutter defining an aperture for selective receipt of the wing when said shutter slides along the axial direction on said burner tube.

7. The gas burner assembly of claim 1, wherein said boss comprises a fastener for fixing said shutter relative to said burner tube.

8. A gas burner assembly for an appliance, the gas burner assembly defining a radial direction, a circumferential direction, and an axial direction, the gas burner assembly, comprising:

a gas line bracket having an orifice;

a burner tube extending between a first end portion and a second end portion along the axial direction, said burner tube defining an inlet at the first end portion of said burner tube, the inlet of said burner tube is spaced apart from the orifice of said gas line bracket at the first end portion of said burner tube, said bunter tube also defining a window at the first end portion of said burner tube;

a cover slidably mounted to said burner tube at the first end portion of said burner tube, said cover defining an opening for receipt the orifice of said gas line bracket, said cover also defining a slot having an axially extending portion; and a boss mounted to said burner tube and received within the slot said cover so as to guide movement of said cover along the axial direction, wherein said cover is slidable on said burner tube along the axial direction via the axially extending portion of the slot of said cover between a working position and an orifice changing position, the orifice of said gas line bracket received within the opening of said cover such that said cover extends between the orifice of the gas line bracket and the inlet of the burner tube in the working position, said cover and said burner tube spaced apart from and not contacting the orifice of said gas line bracket such that the orifice of said gas line bracket is accessible and removable in the orifice changing position, wherein the slot of said cover defines a circumferentially extending portion that extends between a first side portion and a second side portion along the circumferential direction, said boss movable within the circumferentially extending portion of the slot between the first side portion of the circumferentially extending portion and the second side portion of the circumferentially extending portion, said cover adjusting an outlet size of the window of said burner tube when said boss moves within the circumferentially extending portion of the slot between the first side portion of the circumferentially extending portion and the second side portion of the circumferentially extending portion.

9. The gas burner assembly of claim 8, wherein the first end portion of said burner tube and the orifice of said gas line bracket are spaced apart from each other along the axial direction.

10. The gas burner assembly of claim 8, wherein said burner tube and the orifice of said gas line bracket are coaxially aligned in the axial direction.

11. The gas burner assembly of claim 8, wherein said gas line bracket comprises a threaded post, the orifice of said gas line bracket screwed onto the threaded post of said gas line bracket.

12. The gas burner assembly of claim 8, wherein said burner tube comprises a Venturi throat positioned at the first end portion of said burner tube.

13. The gas burner assembly of claim 8, wherein said boss comprises a fastener for fixing said cover relative to said burner tube.

14. The gas burner assembly of claim 8, wherein the axially extending portion of the slot is positioned between the first side portion of the circumferentially extending portion and the second side portion of the circumferentially extending portion along the circumferential direction.

* * * * *